US006598882B2

(12) United States Patent
Stubberfield

(10) Patent No.: US 6,598,882 B2
(45) Date of Patent: Jul. 29, 2003

(54) DODGE BALL GAME AND METHOD OF PLAY

(76) Inventor: Veronica M. Stubberfield, 29700 Bek St., Chesterfield, MI (US) 48047

( * ) Notice: Subject to any disclaimer, the term of this patent is extended or adjusted under 35 U.S.C. 154(b) by 0 days.

(21) Appl. No.: 09/919,874

(22) Filed: Aug. 2, 2001

(65) Prior Publication Data

US 2003/0025267 A1 Feb. 6, 2003

(51) Int. Cl.[7] ..... A63F 9/24

(52) U.S. Cl. ..... 273/460; 273/454; 273/459; 273/453; 273/440; 273/317

(58) Field of Search ..... 273/459, 460, 273/461, 440, 441, 453, 454, 455, 317

(56) References Cited

U.S. PATENT DOCUMENTS 1,782,254 A * 11/1930 Breidenbach ..... 273/453
3,747,929 A * 7/1973 Burke ..... 273/333
3,866,911 A * 2/1975 Goldfarb et al. ..... 273/440
3,936,051 A * 2/1976 Walker, Jr. ..... 273/412
4,300,762 A * 11/1981 Goldfarb et al. ..... 273/455
5,236,383 A * 8/1993 Connelly ..... 446/219
5,382,028 A 1/1995 Sciandra et al.
D355,448 S 2/1995 Walter et al.

* cited by examiner

*Primary Examiner*—Raleigh W. Chiu

(57) ABSTRACT

A game suited for children from five years to adulthood. Game apparatus is spider or web shaped electronic device having a grounding stake. Included are 25 foot spider or web-like attachments, having a corresponding colored lights thereon disposed. A proximity sensor monitors a specified perimeter triggering a signal light and/or buzzer, and, alas, cause for elimination. In play, the game involves two ball tossers who attempt to hit the other participating players with web-like round balls, each tosser having five chances to do so. When a player is hit, that player is deemed "snarled," and ousted. Players are "snarled" by crossing a perimeter defined by a pre-set proximity sensor. The tosser may replace the "snarled" player. The last remaining un-"snarled" player wins. Other rules are contemplated.

10 Claims, 6 Drawing Sheets

DODGE BALL GAME AND METHOD OF PLAY

BACKGROUND OF THE INVENTION

1. Field of the Invention

The present invention relates to games for children and adults to play. More particularly, the present invention relates to electronic tossing games.

2. Description of the Related Art

Many games are played, but known games have limitations. Some limitations include lack of flexibility in the number of people who can simultaneously enjoy playing the game; failure to impart active tossing skills, particularly at moving targets; failure to develop dodging skills; and failure to provide structure which simulates a well known subject, such as a spider or spider web. It would be desirable to provide a playable game apparatus and method of playing which embodies all these properties in a single game which is simple to set up and organize.

The familiar game of "dodge ball" is very flexible in number of players, but it is difficult to monitor the dodgers who are confined to a particular area to give the throwers a fair chance to hit a dodger. An apparatus to indicate when a dodger is out of bounds would be helpful and a unit with lights, buzzer or other noise and a cartoon or animal theme would enhance the attractiveness of the game.

U.S. Pat. No. 5,382,028, issued Jan. 17, 1995, to Sciandra et al., describes an apparatus and method of play for a disc tossing game comprising two cylindrical containers into which the opposing players toss discs from a specified distance. The '028 patent does not provide for dodging skills or electrical disqualification signals.

U.S. Pat. No. Des. 355,448, issued Feb. 14, 1995, to Walter et al., and U.S. Pat. No. Des. 426,269, issued Jun. 6, 2000, to Miller, Jr. et al. describe a spiral spider web game board and a hand activated light pad game apparatus, respectively. Neither of these games develop dodging skills, a highly desirable skill at present.

None of the above inventions and patents, taken either singularly or in combination, is seen to describe the instant invention as claimed. Thus, a game solving the aforementioned shortcomings is desired.

SUMMARY OF THE INVENTION

The present invention is a method and apparatus for a group of people to engage in a dodge ball type game. The game is especially suited for children from five years old and up, but it can also be enjoyed by adults as well. The game apparatus is an electronic device shaped in the character of a spider, which is nailed to the ground by an apparatus engaging stake.

The device includes a plurality of lines simulating spider legs and having spider body proximate ends and player-held handle bearing distal ends, each attachment measuring about 25 feet in length and having a corresponding colored light connected at the spider body, thereby limiting the players' boundary. The players holding the handles are known as prey. If a prey moves outside the boundary, that player's signal light and/or buzzer is triggered by means of a switch activated by the pull of that player's line, which is cause for immediate elimination of the player from the game. Each combination of colored light, switch, line and handle forms an accommodation for each player. There are preferably eight accommodations, thus resembling a spider body and legs.

In play, the game generally involves two ball tossers, called spiders, spaced about 50 feet from each other on opposite sides of the spider body who attempt to hit the other participating players with a round ball. The ball may be decorated with a web-like design if desired. When a prey is hit, that player is designated as "snarled" and immediately ousted from the game. The prey may also be "snarled" by stepping outside the established perimeter, thus pulling the designated line and triggering the corresponding signal light and buzzer. The first two prey to be snarled become the spiders in the following game. The last remaining player in the game who is not "snarled" wins the game. As an alternative, each spider has 10 tosses to snarl the last prey in the game. If the last prey is not snarled, he is designated a "survivor" and the next game is begun. In another modification of the game, the tosser or spider takes the place of the prey that is hit or "snarled." A variety of other play methods and specific rules of play are contemplated.

Accordingly, it is a principal object of the invention to provide a toss and dodge game method and apparatus.

It is another object of the invention to provide a game as above which is flexible in the number of players who may reasonably enjoy playing at once.

It is a further object of the invention to provide a game as above which develops both tossing and dodging abilities.

Still another object of the invention is to provide a game as above having a system which immediately identifies participants who retreat out of a set boundary.

Yet another object of the invention is to provide a game as above having apparatus which possesses spider-like character.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a method and apparatus for a group of people to engage in a dodge ball type game. The game is especially suited for children from five years old and up, but it can also be enjoyed by adults as well. The game apparatus is an electronic device shaped in the character of a spider, which is nailed to the ground by an apparatus engaging stake.

The device includes a plurality of lines simulating spider legs and having spider body proximate ends and player held handle bearing distal ends, each attachment measuring about 25 feet in length and having a corresponding switch and colored light connected at the spider body, thereby limiting the players' boundary. The players holding the handles are known as prey. If a prey moves outside the boundary, that player's signal light and/or buzzer is triggered by means of a switch activated by the pull of that player's line, which is cause for immediate elimination of the player from the game. The game preferably provides accommodations for eight dodgers or prey, the accommodations including at least a colored light, a switch, a line and a handle. The lines, in combination with the spider body gives a spider-like character to the game apparatus.

In play, the game generally involves two ball tossers, called spiders, spaced about 50 feet from each other on opposite sides of the spider body who attempt to hit the other participating players with a round ball. The ball may be decorated with a web-like design if desired. When a prey is hit, that player is designated as "snarled" and immediately ousted from the game. The prey may also be "snarled" by stepping outside the established perimeter, thus pulling the designated line and triggering the corresponding signal light and buzzer.

The first two prey to be snarled become the spiders in the following game. The last remaining prey in the game who is not "snarled" wins the game. As an alternative, each spider has 10 tosses to snarl the last prey in the game. If the last prey is not snarled, he is designated a "survivor" and the next game is begun. In another modification of the game, the tosser or spider takes the place of the prey that is hit or "snarled." A variety of other play methods and specific rules of play are contemplated.

Figure 1:
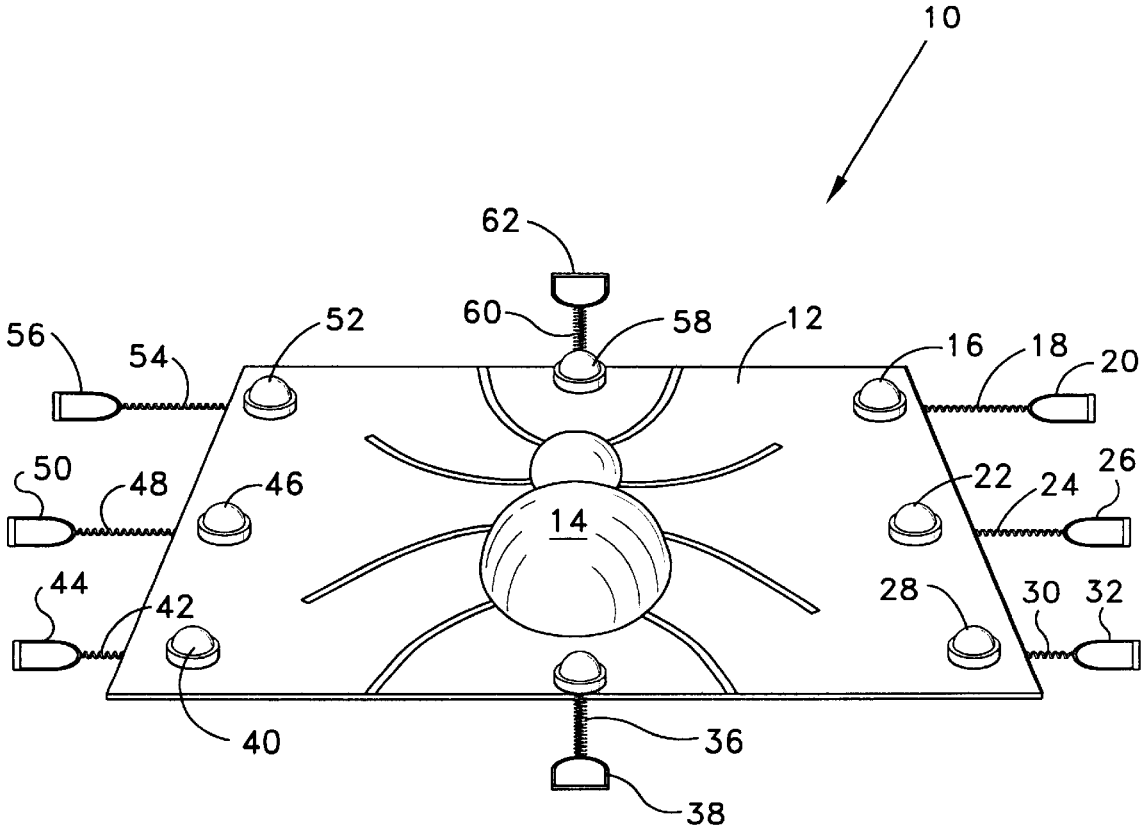
FIG. 1 is an environmental, top perspective view of a game apparatus according one embodiment of the present invention, featuring eight line length restricted player handles.
Figure 2:
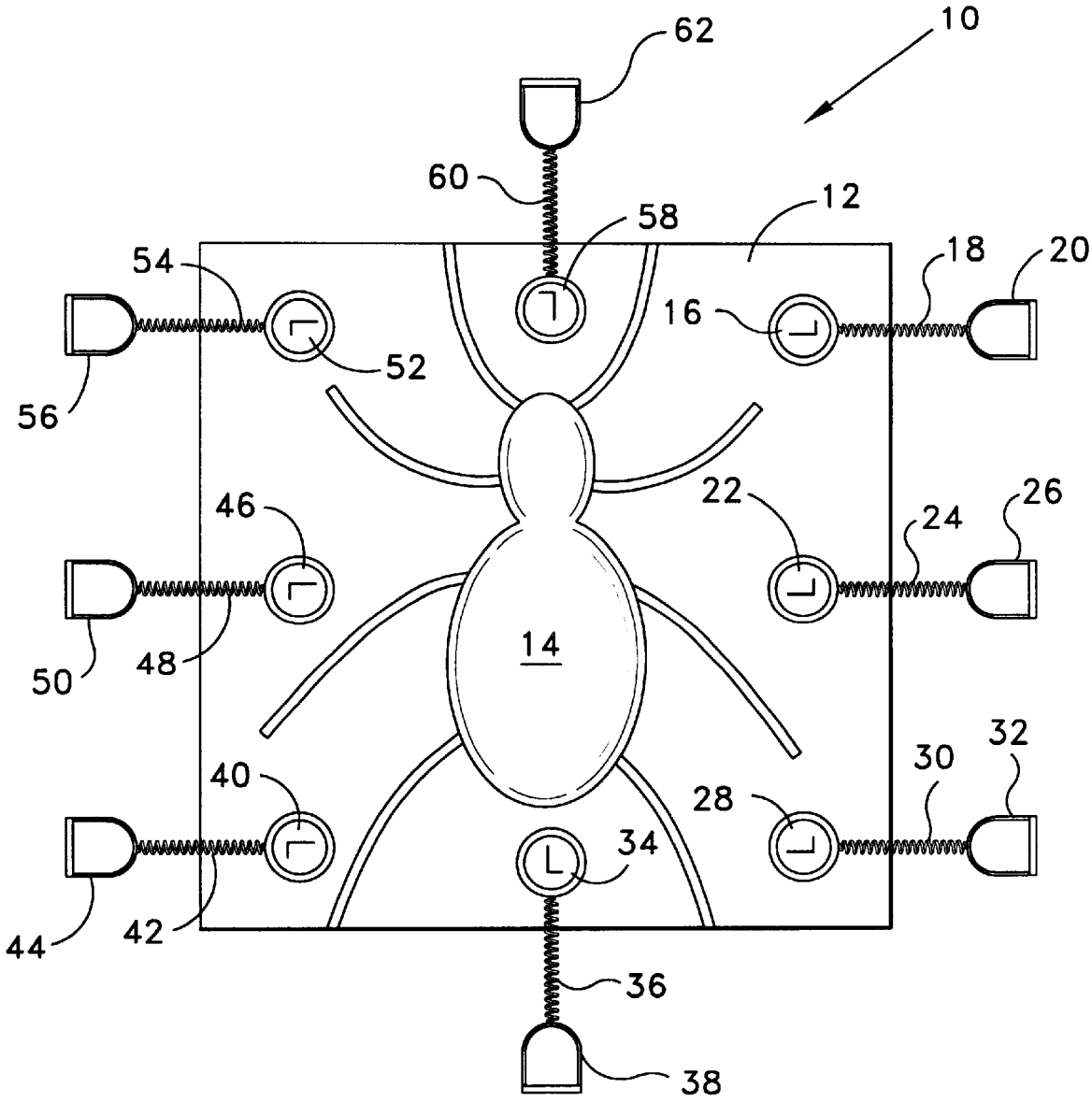
FIG. 2 is a diagrammatic plan view of the game apparatus of FIG. 1.

Referring to FIGS. 1 and 2 there are shown a perspective view and a plan view, respectively, of the game apparatus 10. Game apparatus 10 includes a spider body 12 having a spider doll 14 located on its upper surface. The spider body is removably attached, preferably by means of removably engaging hook and loop material such as VELCRO®. The spider body 12 may be a rectangular board covered with black felt or other material and is suitable for mounting electrical components. Preferably, eight players or "prey" may be accommodated by lights 16, 22, 28, 34, 40, 46, 52, and 58, the lights being of different colors. Each prey(not shown) is tethered on lines 18, 24, 30, 36, 42, 48, 54, and 60 by holding respective handles 20, 26, 32, 38, 44, 50, 56 and 62. The lines are preferably coiled so as to bias toward the spider body 12.

Figure 3:
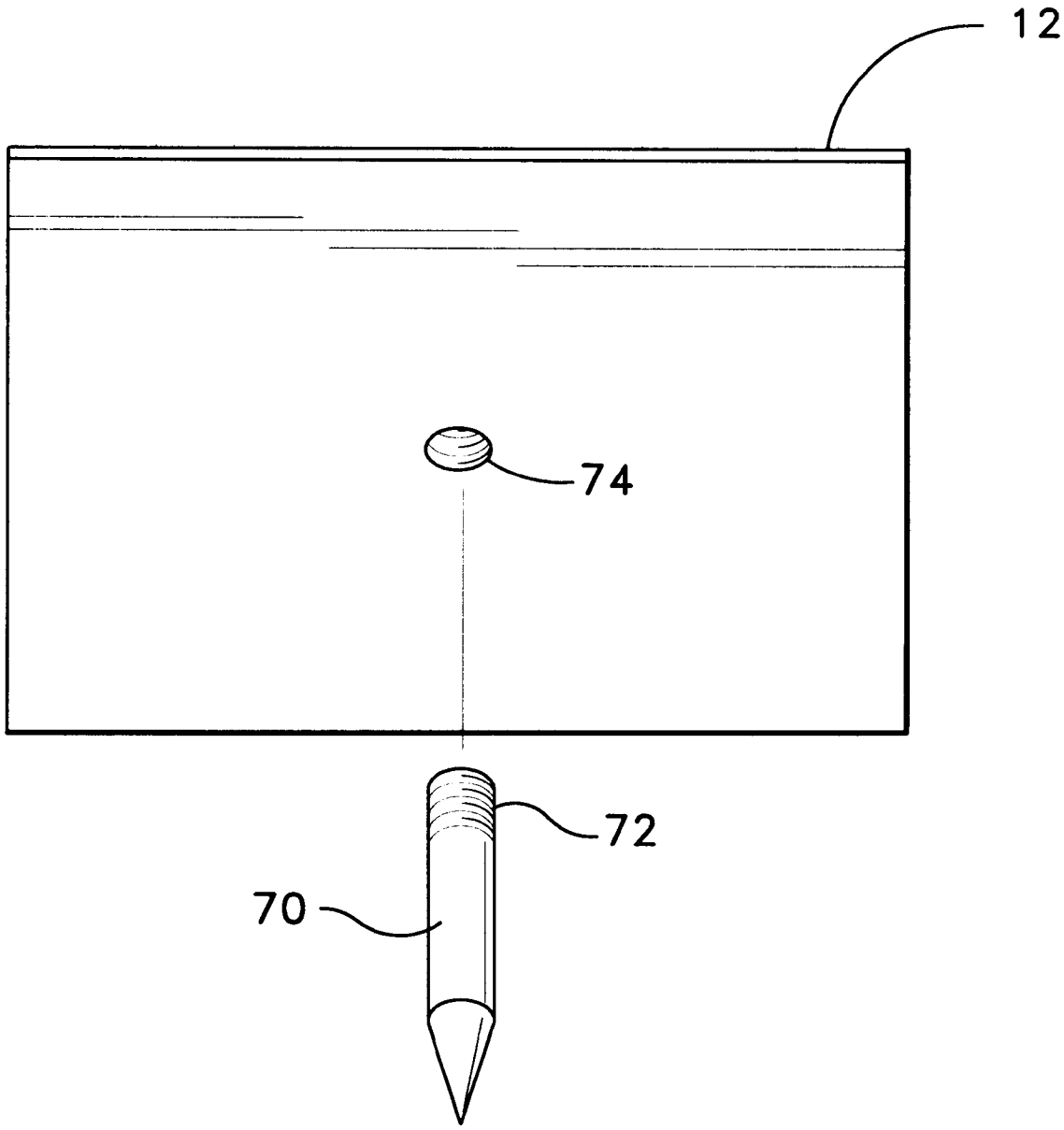
FIG. 3 is a bottom exploded view of the spider body and grounding stake of the present invention.

Referring to FIG. 3 there is a bottom exploded view showing stake 70 having threaded end 72 for engaging threaded hole 74 located in the center of the spider body 12. The stake 70 is driven into the ground and the spider body 12 secured to the stake 70 by rotation of the spider body 12 such that threaded hole 74 screws on to stake 70 by means of threaded end 72. Alternative means may be used such as a corkscrew type device.

Figure 4:
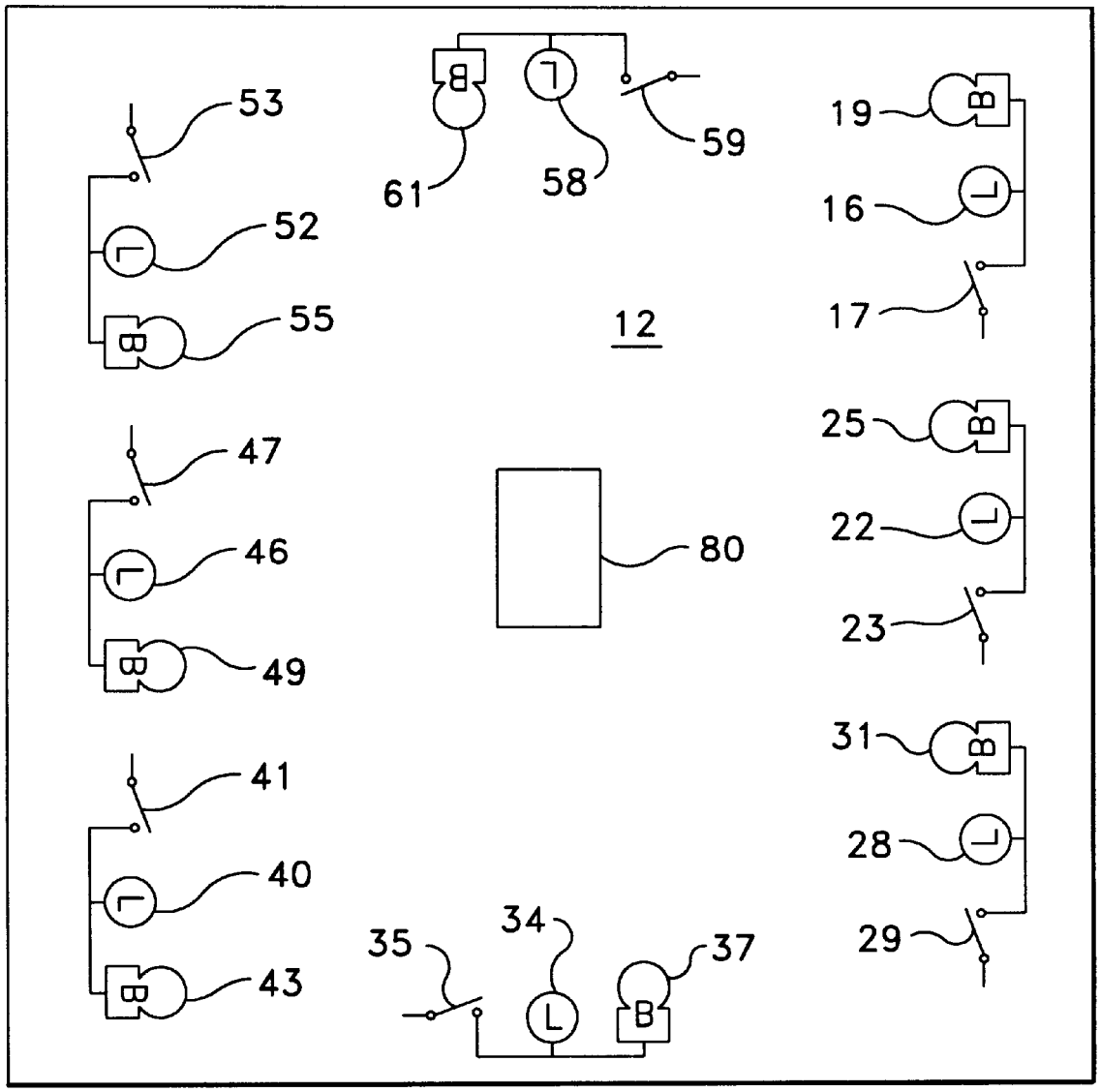
FIG. 4 is a bottom view of one embodiment of the invention, absent wiring, showing a separate buzzer, switch, and light for each player.

Referring to FIG. 4 there is shown a diagrammatic bottom view of the present invention (electrical wiring not shown) where each player or "prey" accommodation has a separate buzzer 19, 25, 31, 37, 43, 49, 55, and 61 activated by corresponding switches 17, 23, 29, 35, 41, 47, 53, and 59, respectively, as well as the corresponding lights 16, 22, 28, 34, 40, 46, 52, and 58. The switches are activated by corresponding lines (see FIGS. 1 and 2). Power is supplied by battery 80.

Figure 5:
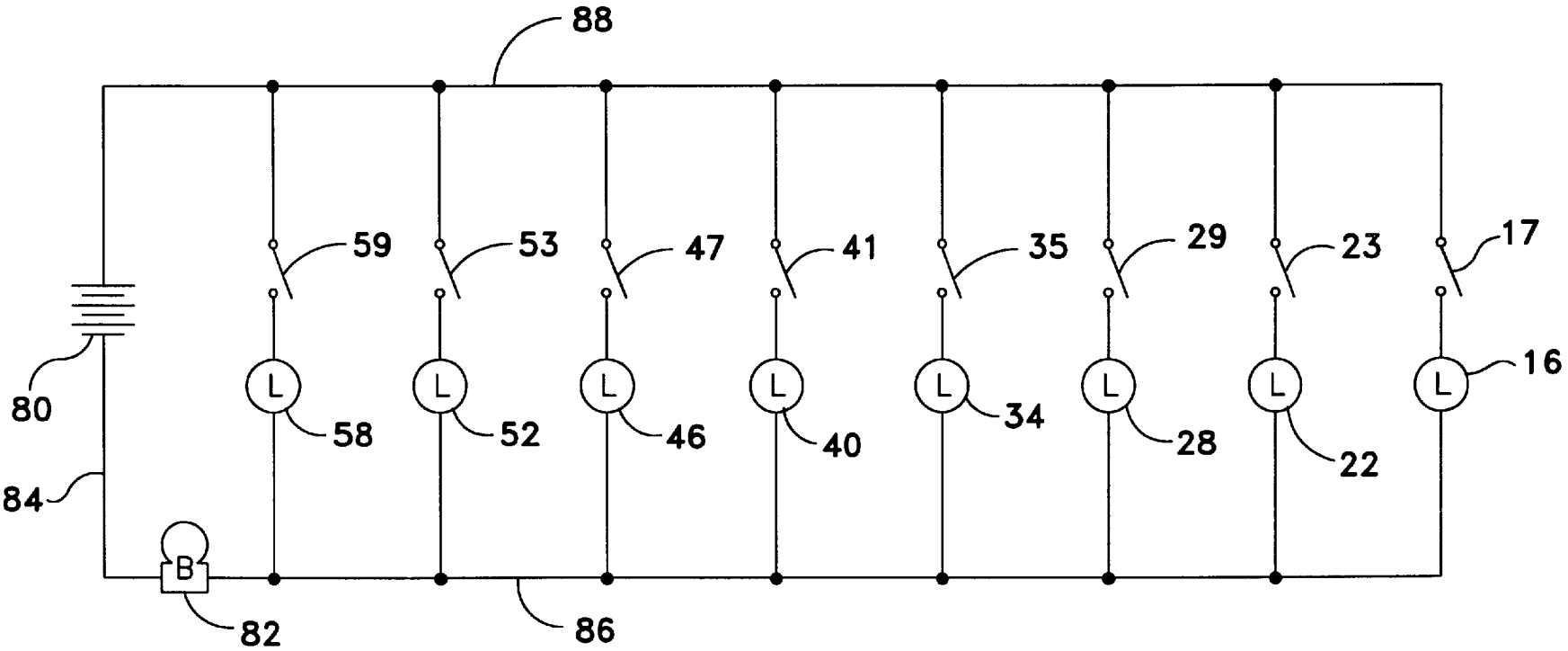
FIG. 5 is a bottom view on another embodiment of the invention showing a wiring diagram for the various switches, lights and a single buzzer powered by a battery.

Referring to FIG. 5, there is shown a wiring diagram of another embodiment of the present invention, illustrating the switch and light elements of the present invention, where a single buzzer 82 is employed and wherein electrical power is supplied to the switches by means of line 88 from battery 80 and, upon activation by an individual switch by pulling on its corresponding line (not shown), electrical connection of its corresponding light is made to the negative pole of battery 80 by line 86, and electrical connection is made with the buzzer 82 by means of line 84 which, in turn, is connected with the battery 80.

Figure 6:
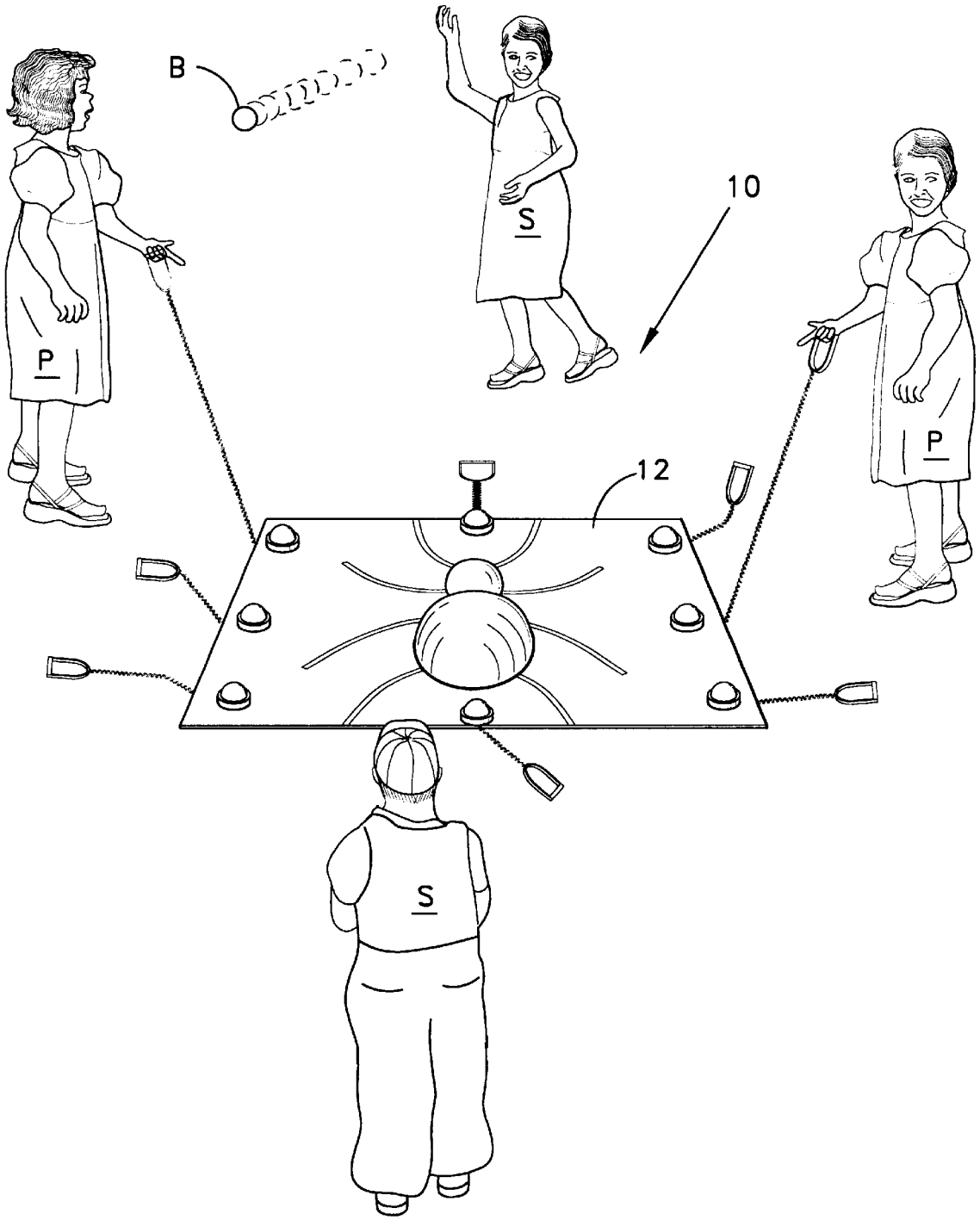
FIG. 6 is an environmental view of children playing the dodge ball type game of the present invention.

Referring to FIG. 6 there is shown an environmental depiction of the inventive game apparatus of the present invention. Tossers or spiders S attempt to hit dodgers or prey P with ball B. The prey P must maintain grasp of a designated handle (see FIG. 1), and if the prey P runs outside the designated area defined by the length of the line, the line pulls a switch which lights their designated light and activates a buzzer (not shown). The preferred maximum length of the lines are 25 feet and the switch will not be tripped until the player attempts to exceed that distance from the spider body 12.

In operation, up to eight players designated "prey" are accommodated by grabbing their respective handles deploying the attached lines so as to provide a moving target for two players designated "spiders" who toss one or more web-like balls at the prey. Any prey hit by a ball is considered "snarled" and must leave the game, much like in a form of dodge ball. The line has a proximate end attached to the spider body, the line preferably being 25 feet in length, and a distal end attached to the handle. Any prey must maintain grasp of his respective handle to remain in the game and if he travels outside the 25-foot boundary the line is pulled which activates a switch. The switch, once activated electrically connects a buzzer and a designated light with a battery and are thus activated, the designated light indicating which prey must leave the game.

The two players designated as spiders are preferably about 50 feet apart and located on opposing sides of the spider body. They continue to alternately throw the ball at the prey until only one is left. That prey may be considered a "survivor" at that point, or the spiders may each have 10 throws to hit the last prey until he is declared a survivor. In the next game, the first two prey "snarled" in the last game are the designated spiders. In another game, a prey who is "snarled" by a spider switches positions with the spider and the game continues continuously.

It is to be understood that the present invention is not limited to the embodiments described above, but encompasses any and all embodiments within the scope of the following claims.

I claim:

1. A game apparatus for playing a dodge ball type game comprising:

an immobilized spider body having accommodations for a plurality of players, each of said accommodations comprising:

a source of electrical power;

an electrical switch;

a line having a proximate end attached for activating said switch and a distal end;

a handle connected at the distal end of said line; and a colored electric light activated by said switch; and at least one tossing ball;

whereby, each of the of players respectively grasps the handle while at least one other player throws the at least one ball at one of the players in an attempt to hit the one player, and wherein the one player attempts to dodge the thrown ball while maintaining grasp of the handle without activating the electrical switch.

2. The game apparatus of claim 1, further comprising a buzzer activated by said switch.

3. The game apparatus of claim 2, wherein there is a light of a different color for accommodating each of said players.

4. The game apparatus of claim 2, wherein there is a separate buzzer for each player.

5. The game apparatus of claim 2, wherein there is a single buzzer for all players.

6. The game apparatus of claim 1, wherein each said line is about 25 feet in length.

7. The game apparatus of claim 1 wherein said game apparatus has separate accommodations for eight players.

8. The game apparatus of claim 1 wherein said game apparatus comprises a plurality of tossing balls.

9. The game apparatus of claim 1 wherein said spider body includes a removably attached doll resembling a spider.

10. A method of playing a dodge ball game comprising:

designating up to eight players as dodgers, known as prey;

designating two players as ball tossers, known as spiders;

each of said prey maintaining a grasp on one of eight handles which are attached to electric switches by intervening lines, said switches being mounted on a central immobile body and operating corresponding colored lights and a buzzer mounted on said body;

whereby one of said spiders alternately tosses a ball in an attempt to hit prey, a hit prey being considered "snarled" and out of the game; and whereby a prey who travels further than the length of the line between the handle and said immobile body trips the corresponding switch which lights the associated light and buzzer, designating that prey to be "snarled" and, thus, out of the game.

* * * * *